US005544437A

United States Patent [19]

Lanoie

[11] Patent Number: 5,544,437

[45] Date of Patent: Aug. 13, 1996

[54] INSTRUMENT DISPLAY CAP WITH PIVOTING TOP

[75] Inventor: Louis A. Lanoie, West Warwick, R.I.

[73] Assignee: Phenix Group, Inc., West Warwick, R.I.

[21] Appl. No.: 489,986

[22] Filed: Jun. 12, 1995

[51] Int. Cl.[6] ..... B43K 23/00

[52] U.S. Cl. ..... 40/334; 40/725; 401/98; 401/52

[58] Field of Search ..... 40/334, 311, 334; 401/98, 52, 202, 213, 243

[56] References Cited

U.S. PATENT DOCUMENTS

| | | | |
|---|---|---|---|
| 1,305,245 | 6/1919 | Barthelemy | 40/334 |
| 1,412,938 | 4/1922 | Halket | 40/334 |
| 1,514,002 | 11/1925 | Kraker | 40/334 |
| 1,655,365 | 1/1928 | Gurtov | 40/334 |

FOREIGN PATENT DOCUMENTS

| | | | |
|---|---|---|---|
| 781594 | 4/1935 | France | 30/334 |

*Primary Examiner*—Kenneth J. Dorner
*Assistant Examiner*—Cassandra Davis
*Attorney, Agent, or Firm*—Barlow & Barlow, Ltd.

[57] ABSTRACT

An instrument display cap, which is capable of interchanging a display member without modifying the structure of the cap, is provided. The instrument display cap includes a tubular tapered body with a transparent disk, pocket and centering member arrangement pivotally positioned in the top open end of the tubular tapered body. A retaining ring, with a spring clip connected thereto, retains the transparent disk, pocket and centering member in place while permitting it to pivot. The transparent disk, pocket and centering member arrangement pivots open to permit the replacement of a display member, such as a photo, or the like, to be easily installed within the pocket. The pivoting arrangement is pivoted closed to display the display member at the top portion of the instrument display cap.

10 Claims, 3 Drawing Sheets

INSTRUMENT DISPLAY CAP WITH PIVOTING TOP

BACKGROUND OF THE INVENTION

The present invention relates generally to a cap for instruments. More specifically, the present invention relates to a cap for instruments, namely writing instrument such as pens and pencils, which has the capability of esthetically displaying an image, such as a photo, printed picture, advertisement or the like.

In the field of instruments, namely writing instruments, it has been well known to incorporate an image, emblem, photo, advertisement, or the like, into or on the writing instrument or cap of the instrument itself. For example, in the prior art, it has been well known to solder a display member directly onto the clip of the writing instrument itself. The display member often includes an enamel image of a company logo or advertisement. In addition, it has been known for a piece of material, which carries an image such as photograph, printed logo or advertisement, to be embedded within clear plastic to then, in turn, be glued to the top portion of a writing instrument. As a result, the photograph, advertisement or logo can be seen at all times through the plastic.

However, these known caps and display methods for instruments suffer from many disadvantages. In particular, these prior art devices are each permanent in nature where the photo or advertisement displayed cannot be changed without significant effort or change to the structure of the instrument. For example, a soldered-on display member is not conducive to being changed because re-soldering of a new display member is required.

Various attempts in the prior art have been made to solve the aforementioned problems. For example, U.S. Pat. No. 1,305,245, issued to Barthelemy, discloses a device for displaying photographs which includes a frame connected to a sheath with spring tongues which are capable of being placed on a pen or pencil. This device suffers from the disadvantages of being cumbersome, as well as difficult and expensive to assemble and manufacture.

Due to the demand for an instrument cap, which can be assembled and manufactured at low cost, it is desirable for an instrument display cap to include relatively few parts which can be quickly and easily assembled. It is also desirable for the instrument or instrument display cap to provide a quick and easy way for the user to change the photograph or advertisement being displayed without structurally modifying the device or compromising the integrity of the structure of the device. In addition, it is also desirable to provide an instrument display cap which is compact in design yet still esthetically attractive.

SUMMARY OF THE INVENTION

The present invention preserves the advantages of prior art instrument display caps for use in connection with writing instruments or the like. In addition, it provides new advantages not found in currently available instrument display caps, and overcomes many disadvantages of such devices.

The invention is generally directed to a novel and unique display cap for instruments with particular application in providing a protective and decorative cap which is capable of displaying any desired image. The instrument display cap of the present invention enables the simple, easy and inexpensive assembly of a cap for protecting and decorating an instrument, such as a writing instrument, while providing a compact esthetically pleasing design.

The preferred embodiment of the present invention includes four primary members. A substantially tubular body is provided with a bottom open end and a top open end. The bottom end has a first diameter while the top open end has a second diameter. The top open end forms a top edge describing a circle and a plane which is positioned less than 90° and greater than 0° relative to the central longitudinal axis of the tubular body. The tubular body is preferably tapered out going from the bottom to the top where the first diameter is smaller than the second diameter positioned at its top. The second primary member is a disk which is pivotally positioned on the tubular body at its top open end. Since the tubular body is tapered, the disk sits within the top open end of the tubular body and is permitted to pivot therein. The disk is permitted to pivot to a stop point where it is substantially coplanar and coaxial with the circle described by the top edge of the tubular body. In addition, a pocket is affixed to the rear surface of the disk for carrying a photo, or the like, between the pocket and the disk with the image side facing to the disk, which is preferably transparent, so that it can be visible therethrough. In addition, a retaining ring is connected to the top edge of the tubular body to contain the transparent disk in pivotal communication with the top open end of the tubular body. Further, a spring clip is provided to facilitate attachment of the cap to another structure, such as a shirt pocket.

In operation, an instrument, such as a pen or pencil, is inserted into the bottom open end and through the tubular body. Preferably, the tip of the instrument inserted into the tubular body is positioned far up enough into the tubular body to contact the rear surface of the pocket to urge the transparent disk, which is displaying the photo, to become coplanar and coaxial with the circle described by the edge at the top of the tubular body. The disk may then be locked in place for display of the photo or other image until a new image or photo is placed within the pocket.

It is therefore an object of the present invention to provide an instrument display cap that can be simply, easily, and inexpensively assembled.

Another object of the present invention is to provide an instrument display cap which can permit the quick and easy replacement of display images without altering the structure of the cap.

It is a further option of the present invention to provide an instrument display cap that is compact in design and inexpensive to manufacture while being esthetically pleasing to look at.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
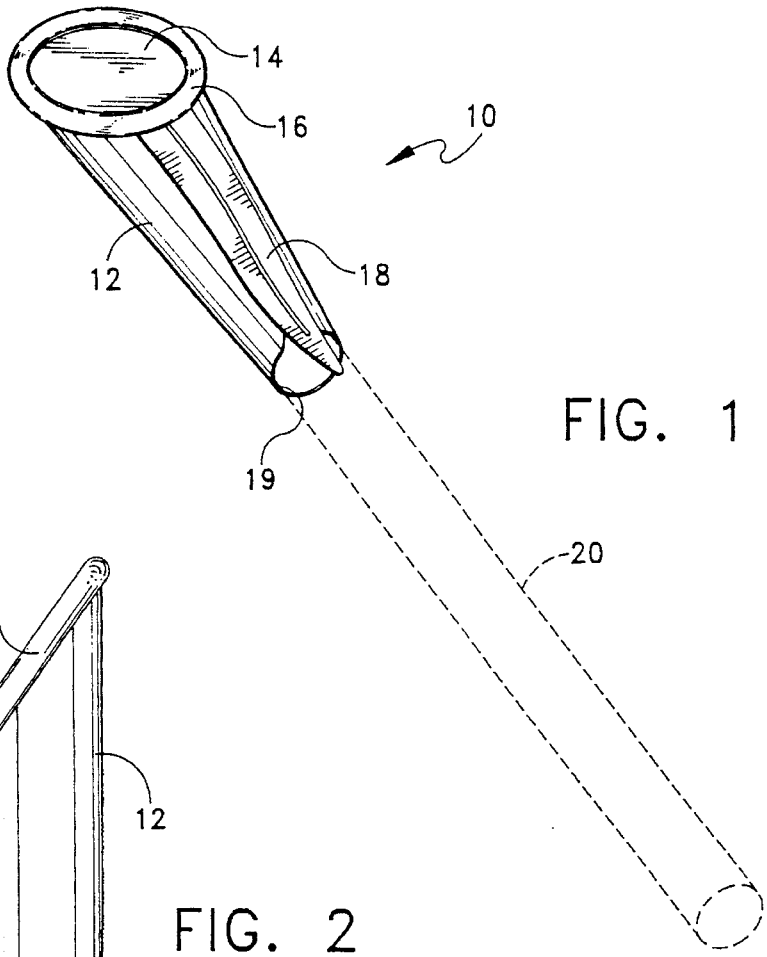
FIG. 1 is a perspective view of the instrument display cap of the present invention installed on an instrument.

Referring to FIG. 1, the instrument display cap 10 of the present invention is generally shown to include a substantially tubular body 12 with a transparent disk 14 being positioned at its top open end. A retaining ring 16 secures transparent disk 14 in place. Spring clip 18 is provided and is preferably connected directly to retaining ring 16. FIG. 1 generally shows a perspective view of the instrument display cap 10 of the present invention installed on an instrument 20. Instrument 20 is inserted through the bottom open end 19 of tubular body 12. Instrument display cap 10 of the present invention is well suited for protecting and decorating writing instruments, such as pens and pencils. In addition, instrument display cap 10 is capable of protecting and decorating other types of instruments, such as precision cutting instruments, temperature probe instruments, and the like.

Figure 2:
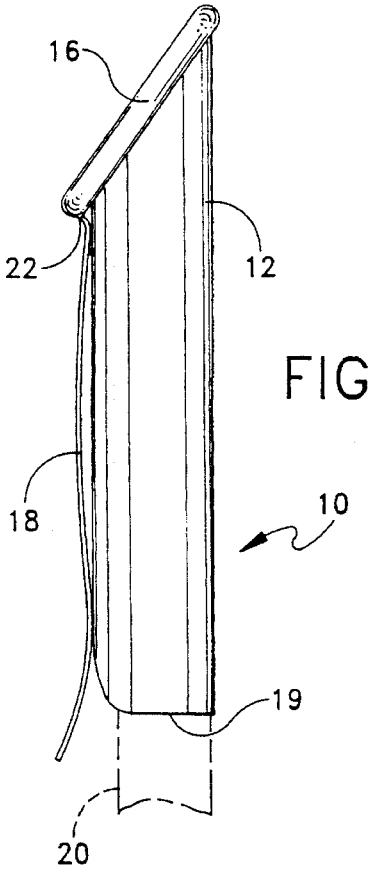
FIG. 2 is a side elevational view of the instrument display cap shown in FIG. 1.

Turning now to FIG. 2, a side elevational view of the present invention is shown. Instrument 20 is inserted through bottom open end 19 of tubular body 12. Retaining ring 16 is connected to the top portion of tubular body 12 for retaining transparent disk 14 as will be described in detail below. In addition, spring clip 18 is preferably connected directly to retaining ring 16 to enable the instrument display cap 10 to be easily affixed to a support structure, such as a shirt pocket, or the like.

Figure 3:
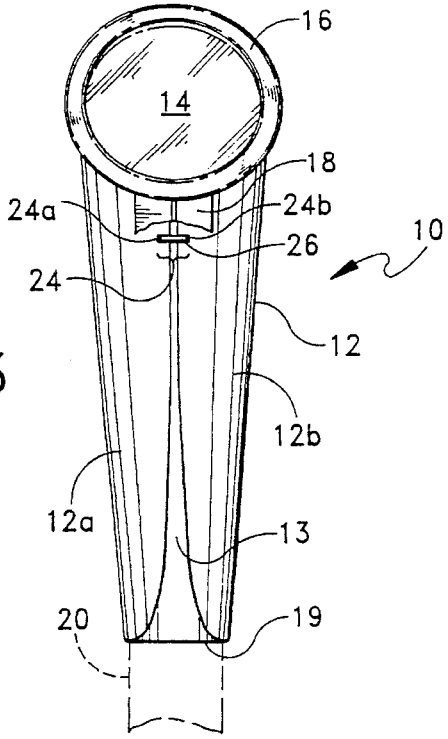
FIG. 3 is a front elevational view of the instrument display cap of FIG. 1 with its spring clip broken away for illustrative purposes.

FIG. 3 illustrates a front elevational view of the instrument display cap 10 of the present invention. For illustrative purposes, spring clip 18 is broken away to permit viewing of additional details of the present invention. Tubular body 12 is preferably tubular and formed from a single sheet of material, such as aluminum or any other suitable material. Preferably, tubular body 12 is formed to create a left side portion 12*a* and a right side portion 12*b* with a gap 13 therebetween. As a result, portions 12*a* and 12*b* of tubular body 12 provide a spring-like biasing when an instrument 20 is received through bottom open end 19. In particular, this spring-like action permits instrument display cap 10 to accommodate instruments having different diameters.

Retaining ring 16 is secured to tubular body 12 by a tongue and notch arrangement. A left notch 24*a* is provided in left side portion 12*a* and right notch 24*b* is provided in right side portion 12*b* to create a lock notch which is generally referred to as 24. Lock notch 24 receives lock tongue 26 therein which is connected to retaining ring 16 via a lock extension 25, which will be discussed in detail in connection with FIGS. 5 and 6. As a result of this locking arrangement, retaining ring 16, with spring clip 18 connected thereto, can be quickly and easily permanently affixed to the top portion of tubular body 12. Retaining ring 16 is simply placed over the top portion of tubular body 12 and lock tongue is snapped into place within lock notch 24. Top edge 23 resides in circumferential retaining ring seat 27.

Figure 4:
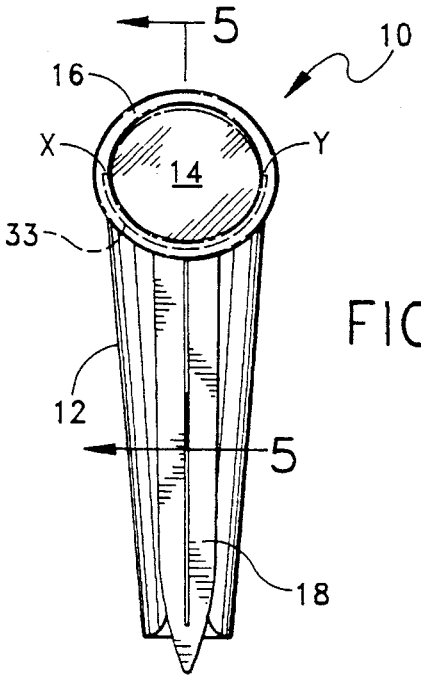
FIG. 4 is a front elevational view of the instrument display cap of FIG. 1.
Figure 5:
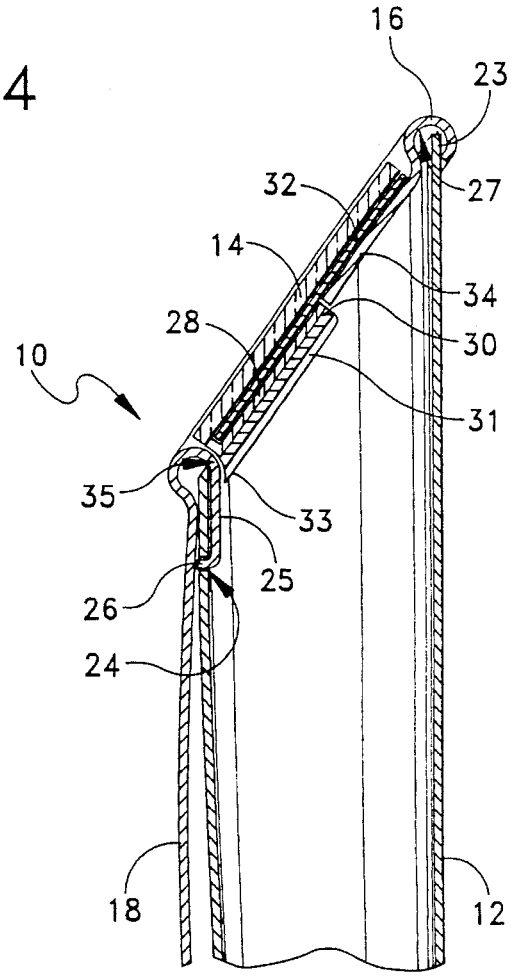
FIG. 5 is a cross-sectional view through the line 5—5 of FIG. 4 with the transparent disk in a closed position.

FIG. 4 is a front elevational view of the instrument display cap 10 of the present invention. As can be seen, spring clip 18 is fully illustrated to show that it is connected to retaining ring 16 and extends longitudinally down along the length of tubular body 12. Referring now to FIG. 5, a cross-sectional view along the line 5—5 of FIG. 4 is shown. In particular, FIG. 5 illustrates the instrument display cap 10 in a closed and image displaying condition. Retaining ring 16 has connected to it, on its outer edge, spring clip 18. Connected to the inner edge of retaining ring 16 is a lock extension 25 with a lock tongue 26 emanating from its free end. Lock tongue 26 engages with lock notch 24 to secure retaining ring 16 to the top of tubular body 12 at top edge 23.

Positioned within the top of tubular body 12 is a disk 14 and pocket 28 arrangement for displaying display member 32 which may be a photo, picture, or the like. Still referring to FIG. 5, pocket 28 is affixed to the rear or bottom surface of transparent disk 14. Transparent disk is preferably made of clear plastic but may also be made of glass. Preferably, pocket 28 is semicircular in shape to cover the lower half of the rear of transparent disk 14. Retaining ring 16 includes a semicircular plate 34 which substantially mates with the semicircular pocket 28. The combined structure of pocket 28 and semicircular plate 34 provides a substantially circular backing structure for supporting a display member 32.

In addition, a centering member 30 may be provided on the rear surface of pocket 28, or integrally formed with pocket 28, to provide a structure for centering an instrument received within tubular body 12. Groove 31 and centering member 30 further assists the centering of an instrument received. The employment of such a centering member 30 with groove 31 will be discussed in more detail in connection with FIGS. 7 and 8.

Figure 6:
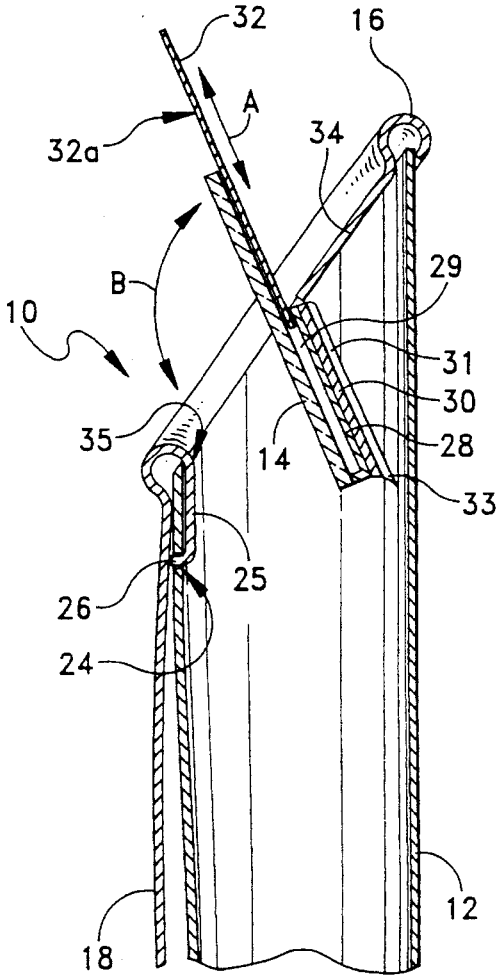
FIG. 6 is a cross-sectional view through the line 5—5 of FIG. 4 with the transparent disk pivoted into an open position to permit replacement of a display image.

FIG. 6 illustrates the instrument display cap 10 in an open condition to enable the quick and easy replacement of a display member residing within pocket 28. The structure of transparent disk 14, pocket 28 and centering member 30 are fixed to one another to form a single arrangement. The left side of this arrangement, as seen through a front elevational view as in FIG. 4, and referred to in general as X, bears against the left side of the inner wall of tubular body 12. Similarly, the right side, generally referred to as Y, bears against the right side of the inner wall of tubular body 12. Since transparent disk 14, pocket 28 and centering member 30 have a diameter substantially equal to the top open end of tubular body 12 and the fact that tubular body 12 tapers inwardly toward its bottom open end, the arrangement of transparent disk 14, pocket 28 and centering member 30 pivotally sit at the top open end of tubular body 12 where they can pivot freely at points X and Y.

Referring back to FIG. 6, the transparent disk 14, pocket 28 and centering member 30 arrangement can be pivoted to lift transparent disk 14 off of semicircular plate 34 to expose display member 32. The pivoting of this structure is indicated by reference B. When the pivoting arrangement has been opened, display member 32 may be removed along the direction referenced A. A replacement display member, such as a photo, or the like, may be replaced into pocket 28 into space 29 therein with image or printed side 32*a* facing towards transparent disk 14.

Figure 7:
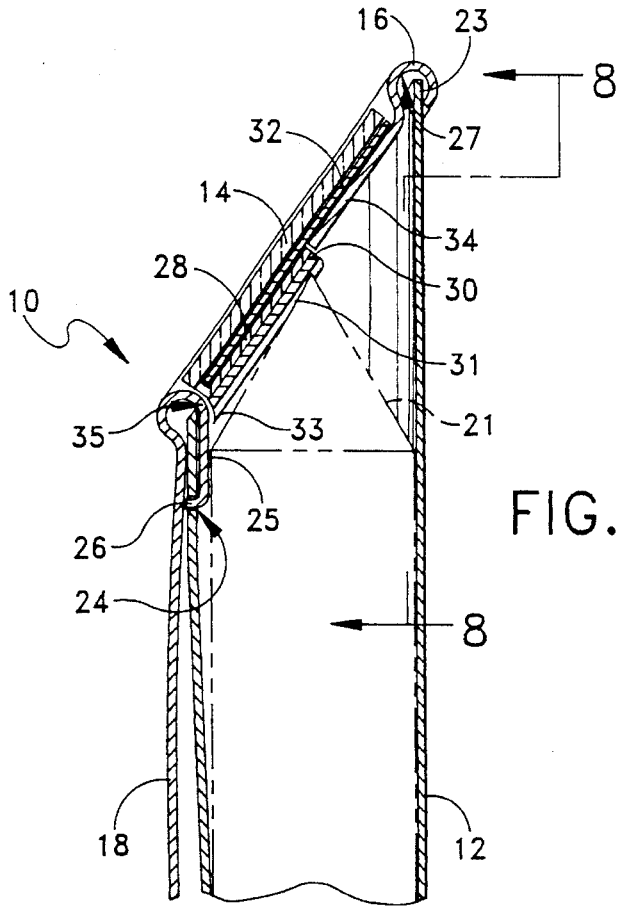
FIG. 7 is a cross-sectional view through the line 5—5 of FIG. 4 with the tip of an instrument being in communication with the centering member.

After display member 32 has been inserted into pocket 28, the pivoting structure can be pivoted (clockwise in FIG. 6) to sandwich the top portion of display member 32 between the top portion of transparent disk 14 and semicircular plate 34. The resultant closed condition of the instrument display cap 10 is illustrated in FIG. 5. Additional structure (not shown) may be provided to snap the pivoting arrangement into place. Preferably, as seen in FIGS. 5–7, a peripheral stop member 33 is provided as an extension to the centering member 30 to contact inner surface edge 35 of retaining ring 16. As designated by the dotted lines in FIG. 1, stop member 33 is preferably positioned about the periphery of the lower semicircle half of the transparent disk 14, pocket 28, and centering member 30 arrangement to prevent this entire pivoting arrangement from being separated from tubular body 12. Alternatively, pocket 28 may be extended to create a pivot stop. Other ways may be employed to serve as a pivot stop. For example, a peripheral groove may be provided about the periphery of transparent disk 14 on its edge to provide a snap fit with the rounded inner edge 35 of retaining ring 16.

Figure 8:
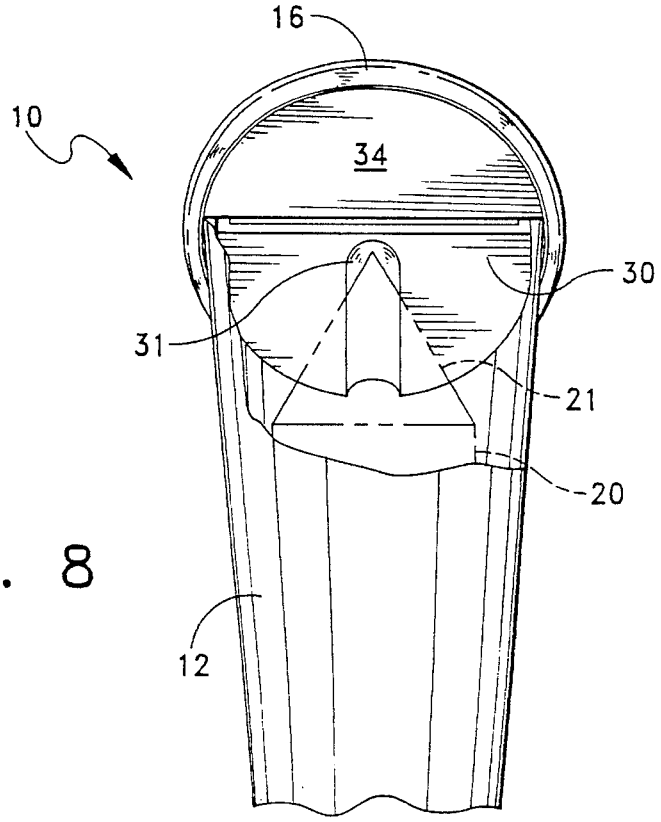
FIG. 8 is a cross-sectional view through the line 8—8 of FIG. 7.

Turning now to FIGS. 7 and 8, the operation of centering member 30 and groove 31 therein is shown in detail. FIG. 7 illustrates a cross-sectional view of the instrument display cap 10 with an instrument fully inserted into tubular body 12. Instrument tip 21 of instrument 20 resides within groove 31 of centering member 30. Referring both to FIGS. 7 and 8, when instrument 20 is fully inserted into tubular body 12, tip 21 urges the transparent disk 14, pocket 28 and centering member 30 arrangement to maintain being pivoted as counterclockwise as possible to ensure that display member 32 is completely sandwiched between transparent disk 14 and its support backing formed by pocket 28, at the lower half, and semicircular plate 34, at the upper half. In addition, receipt of instrument tip 21 within groove 31 of centering member 30 ensures that instrument display cap 10 is properly situated and installed on instrument 20 to ensure an even appearance. Moreover, FIG. 8 shows a cross-sectional view through the line 8—8 of FIG. 7 showing the back of semicircular plate 34 and groove 31 for receiving instrument tip 21.

While a transparent disk 14 with pocket 28 is preferred to enable the display of any separate display member, such as a photo, the instrument display cap 10 of the present invention may be modified to where the display disk 14 itself carries indicia, such as a logo or advertisement. For example, disk 14 may alternatively be opaque with an advertisement printed directly thereon. Replacement display disks can be easily substituted according to the user's preference.

It would be appreciated by those skilled in the art that various changes and modifications can be made to the illustrated embodiments without departing from the spirit of the present invention. All such modifications and changes are intended to be covered by the appended claims.

What is claimed is:

1. An instrument display cap, comprising:

a substantially tubular body having a bottom open end and a top open end and an inner wall surface and an outer wall surface; said bottom open end having a first diameter; said top open end having a second diameter and forming a top edge describing a circle in a plane which is positioned less than 90 degrees and greater than zero degrees relative to the central longitudinal axis of said substantially tubular body; said substantially tubular body being tapered out from bottom to top with said first diameter being smaller than said second diameter;

a transparent disk pivotally positioned on said substantially tubular body at said top open end and having a front surface and a rear surface; said transparent disk pivotally communicating with said inner wall surface; said transparent disk having a diameter slightly smaller than said second diameter;

a pocket affixed to said rear surface; and ring means connected to said top edge for retaining said transparent disk in communication with said inner wall surface.

2. The instrument display cap of claim 1, further comprising:

a flat display member disposed between said transparent disk and said pocket.

3. The instrument display cap of claim 2, wherein said pocket is semicircular in configuration and affixed to a lower half portion of said rear surface of said transparent disk; said pocket having a curved edge and a straight edge.

4. The instrument display cap of claim 3, further comprising:

a semicircular plate having a curved edge and a straight edge; said curved edge of said semicircular plate being compacted to said ring means at an upper portion thereof thereby dividing said ring means into an upper semicircular plate portion and a lower semicircular aperture portion; said straight edge of said semicircular plate being matable with said straight edge of said pocket to form a substantially circular support backing; said flat display member being sandwiched being said transparent disk and said support backing.

5. The instrument display cap of claim 2, wherein said flat display member is a photograph.

6. The instrument display cap of claim 2, wherein said flat display member carries printed indicia.

7. The instrument display cap of claim 1, further comprising;

an elongated clip connected to said ring means, said clip being positioned adjacent said outer wall surface and along the length of said substantially tubular body.

8. The instrument display cap of claim 1, further comprising:

a first lock means for securing said ring means to said top edge positioned in an upper portion of said substantially tubular body proximal to said top edge; and a second lock means engageable with said first lock means for securing said ring means to said top edge; said second lock means being connected to said ring means.

9. The instrument display cap of claim 1, wherein said pocket includes a groove in a surface thereof which is not affixed to said transparent disk; said groove being positioned substantially perpendicular to said straight edge of said pocket; said groove being capable of receiving an instrument tip.

10. An instrument display cap, comprising:

a substantially tubular body having a bottom open end and a top open end and an inner wall surface and an outer wall surface; said bottom open end having a first diameter; said top open end having a second diameter and forming a top edge describing a circle in a plane which is positioned less than 90 degrees and greater than zero degrees relative to the central longitudinal axis of said substantially tubular body; said substantially tubular body being tapered out from bottom to top with said first diameter being smaller than said second diameter;

a transparent disk pivotally positioned on said substantially tubular body at said top open end and having a front surface and a rear surface; said transparent disk pivotally communicating with said inner wall surface; said transparent disk having a diameter slightly smaller than said second diameter;

a pocket affixed to said rear surface; said pocket being semicircular in configuration and affixed to a lower half portion of said rear surface of said transparent disk; said pocket having a curved edge and a straight edge;

a flat display member disposed between said transparent disk and said pocket;

ring means connected to said top edge for retaining said transparent disk in communication with said inner wall surface;

stop means connected to said transparent disk for stopping said transparent disk from pivoting;

an elongated clip connected to said ring means; said clip being positioned adjacent said outer wall surface and along the length of said substantially tubular body;

a first lock means for securing said ring means to said top edge positioned in an upper portion of said substantially tubular body proximal to said top edge;

a second lock means engageable with said first lock means for securing said ring means to said top edge; said second lock means being connected to said ring means; and a semicircular plate having a curved edge and a straight edge; said curved edge of said semicircular plate being connected to said ring means at an upper portion thereof thereby dividing said ring means into an upper semicircular plate portion and a lower semicircular aperture portion; said straight edge of said semicircular plate being matable with said straight edge of said pocket to form a substantially circular support backing for said flat display member; said flat display member being sandwiched being said transparent disk and said support backing.

* * * * *